US007210813B2

(12) United States Patent
Harwood

(10) Patent No.: US 7,210,813 B2
(45) Date of Patent: May 1, 2007

(54) COMBINATION LIGHTING MODULE AND TOOL-LESS BUS SYSTEM UTILIZING THE SAME

(76) Inventor: Ronald P. Harwood, 31110 Applewood, Farmington Hills, MI (US) 48331

( * ) Notice: Subject to any disclaimer, the term of this patent is extended or adjusted under 35 U.S.C. 154(b) by 0 days.

(21) Appl. No.: 11/212,543

(22) Filed: Aug. 26, 2005

(65) Prior Publication Data

US 2006/0044841 A1 Mar. 2, 2006

Related U.S. Application Data

(60) Provisional application No. 60/604,772, filed on Aug. 26, 2004.

(51) Int. Cl.
*F21S 4/00* (2006.01)

(52) U.S. Cl. ..... 362/221; 362/648

(58) Field of Classification Search ..... 362/221, 362/648, 219, 260; 439/115, 121
See application file for complete search history.

(56) References Cited

U.S. PATENT DOCUMENTS

| | | | | |
|---|---|---|---|---|
| 5,622,425 | A * | 4/1997 | Lin | 362/249 |
| 5,816,849 | A * | 10/1998 | Schmidt | 439/505 |
| 6,854,860 | B2 * | 2/2005 | Plunk | 362/147 |
| 2002/0018344 | A1 * | 2/2002 | Sears et al. | 362/265 |
| 2002/0137374 | A1 * | 9/2002 | O'Rourke et al. | 439/121 |
| 2004/0090778 | A1 * | 5/2004 | Noh | 362/220 |

* cited by examiner

*Primary Examiner*—Renee Luebke
*Assistant Examiner*—Julie A Shallenberger
(74) *Attorney, Agent, or Firm*—Marshall & Melhorn, LLC

(57) ABSTRACT

A multi-function lighting module providing two or more possible light source capabilities, such as ambient and/or focused and or emergency lighting where power is supplied by an existing bus system, and the module is connected to the existing bus system by a tool-less means of connection.

6 Claims, 3 Drawing Sheets

COMBINATION LIGHTING MODULE AND TOOL-LESS BUS SYSTEM UTILIZING THE SAME

CROSS-REFERENCE TO RELATED APPLICATION

This application claims the benefit, under 35 U.S.C. § 119 (e). of U.S. Provisional Patent Application Ser. No. 60/604,772, filed Aug. 26, 2004, under 35 U.S.C. § 111 (b). Application Ser. No. 60/604,772 is co-pending as of the date of this application, and is incorporated herein, in its entirety, by reference

BACKGROUND OF THE INVENTION

1. Field of the Invention

The present invention relates to lighting. More particularly, the present invention relates to track lighting systems comprising lighting tracks, and fixtures which mount to the lighting tracks. Most particularly, the present invention relates to busways for providing multi-circuit lighting power, and a multi-function lighting module which mounts to existing busways.

2. Description of the Related Art

Busways for providing multi-circuit lighting power are known in the art. Zumtobel Staff Lighting of Highland, N.Y. 12528 (USA) manufactures such a system. Typically, the bus system contains insulated power conductors for single or three phase power. Additionally, the power take-off means is provided by molded female connectors attached to the bus wires. This system, and any similar systems, have provided lighting modules that contain a single lamp type. For example, either fluorescent or incandescent, as the application required. However, in many lighting applications, two lighting sources are required in a single module, and this is not provided for with the present day lighting systems.

SUMMARY OF THE INVENTION

To solve the problem of meeting the needs of retailers, or in any other application where two light sources are required in the same lighting module, the present invention combines two or more possible light source capabilities on a single lighting module wherein power is supplied by a bus system through a tool-less means of connection to provide, for example, a general "ambient" source, and a "focused" light source in a single module. For example, a fluorescent and an incandescent light source may be provided on a single module.

BRIEF DESCRIPTION OF THE DRAWINGS

FIG. 1 is a perspective view of a known wired bus system with internal molded power connection.

DETAILED DESCRIPTION OF THE PREFERRED EMBODIMENTS

Figure 2:
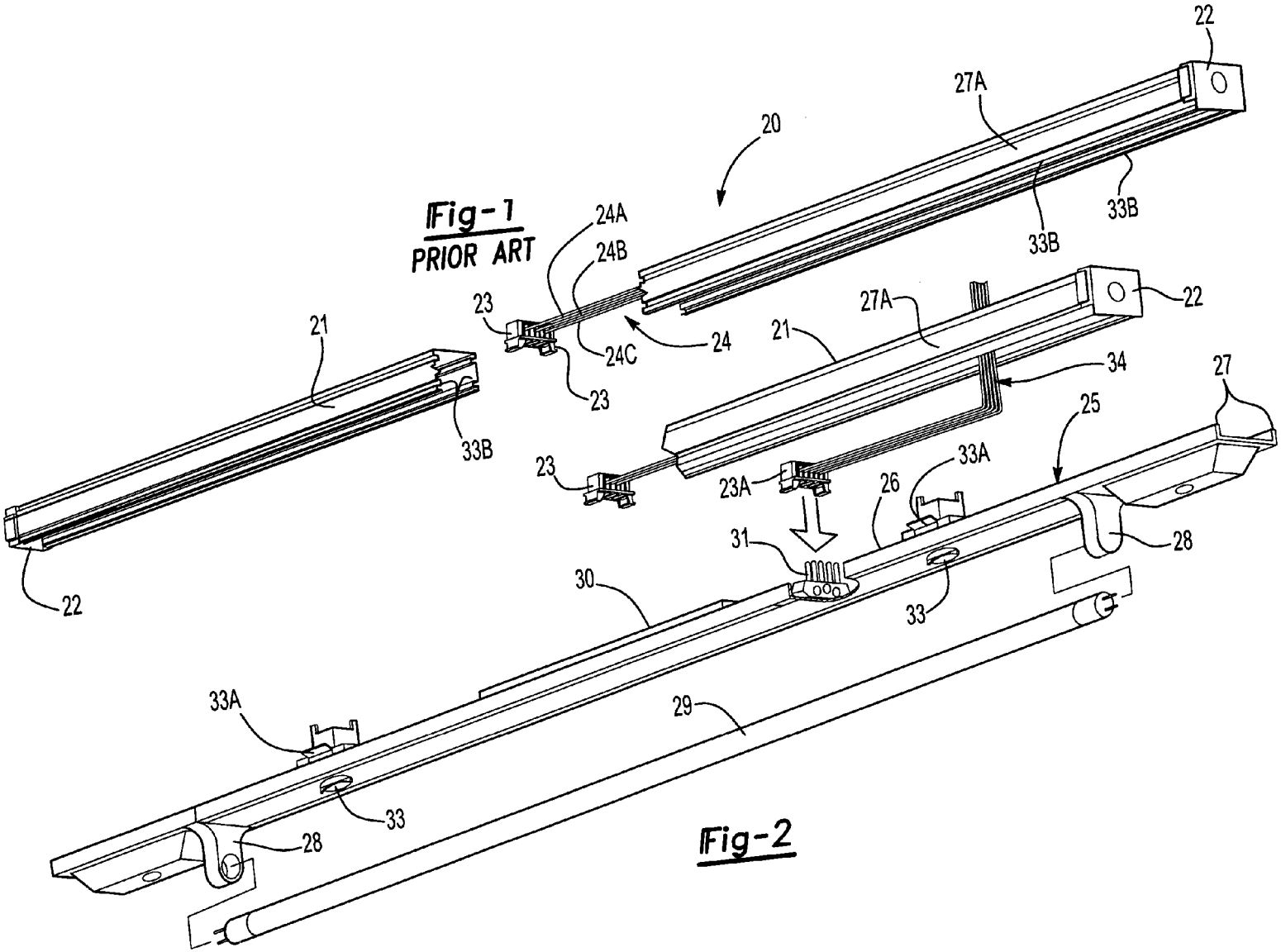
FIG. 2 is an exploded, perspective, view of a multi-function lighting module embodying the present invention, which attaches to the construction shown in FIG. 1.

Referring to FIG. 1, there is illustrated a known wired bus system 20, such as that manufactured by Zumtobel Staff of Highland, N.Y., USA. System 20 may comprise such as at least one trunking portion 21, closed by a pair of end caps 22. Contained internally of the trunking 21 is the bus wiring or harness 24. Power take-off is by means of molded female connectors or fixture receptacles 23, which tap into, or electrically connect to selected bus wires (24A–C) of wiring harness 24.

Referring now to FIG. 2, a multi-functional lighting module embodying the construction of the present invention, and being generally designated by the numeral 25 is shown. Multi-functional lighting module 25 has an axially extending body portion 26 having a pair of parallel, spaced apart, flanges 27, for aligning with, and engaging the sides 27A (FIG. 1) of the trunking 21 of the bus system 20.

Mechanically attached to the body portion 26 of multi-functional lighting module 25 are pair of lamp sockets 28, which receive an ambient light source, such as fluorescent lamp 29, in a manner well known in the art. Lamp sockets 28 are electrically connected to ballast 30, which is mounted to body portion 26 of lighting module 25. Ballast 30 is, in turn, electrically connected to a male fixture plug which, when inserted in a female fixture receptacle (FIG. 1), supplies power to ballast 30. Other "ambient" light sources may be attached to body portion 26 of lighting module 25, if desired. A first male fixture plug 31 may be mounted to body portion 26, if desired, depending on the application. While in the preferred embodiment, the first male fixture plug 31 is firmly attached to the body portion 26 of the multi-functional lighting module 25, it is well within the scope of the present invention that the first male fixture plug 31 be mounted to the body portion 26 by any means well known in the art. It is also within the scope of the present invention that the first male fixture plug 31 be electrically connected to, for example the ballast, and not be attached to the body portion 26 at all.

Figure 3:
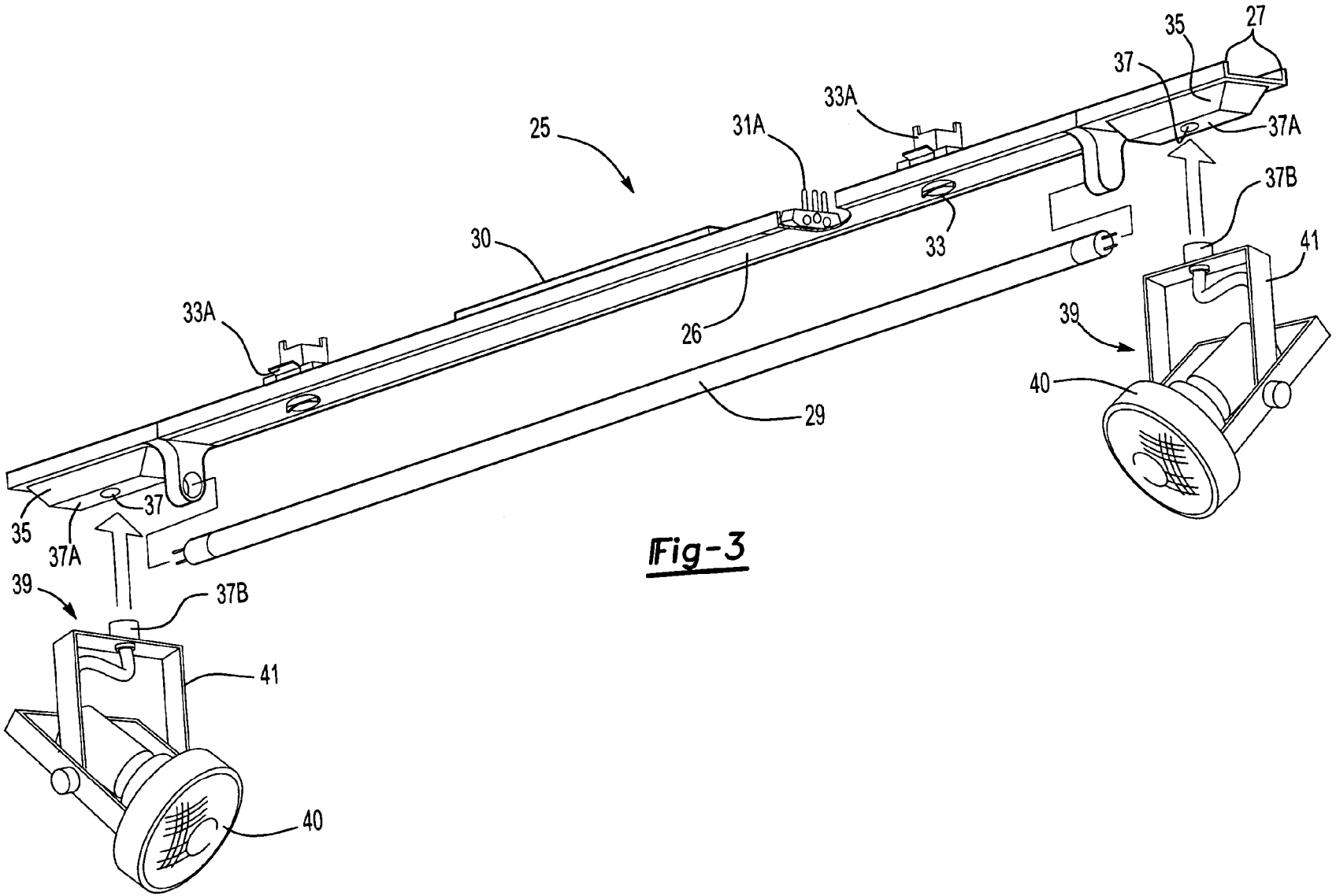
FIG. 3 is a view similar in large part to FIG. 2, and showing, in addition, a pair of focused, or secondary light sources, or track heads.
Figure 5:
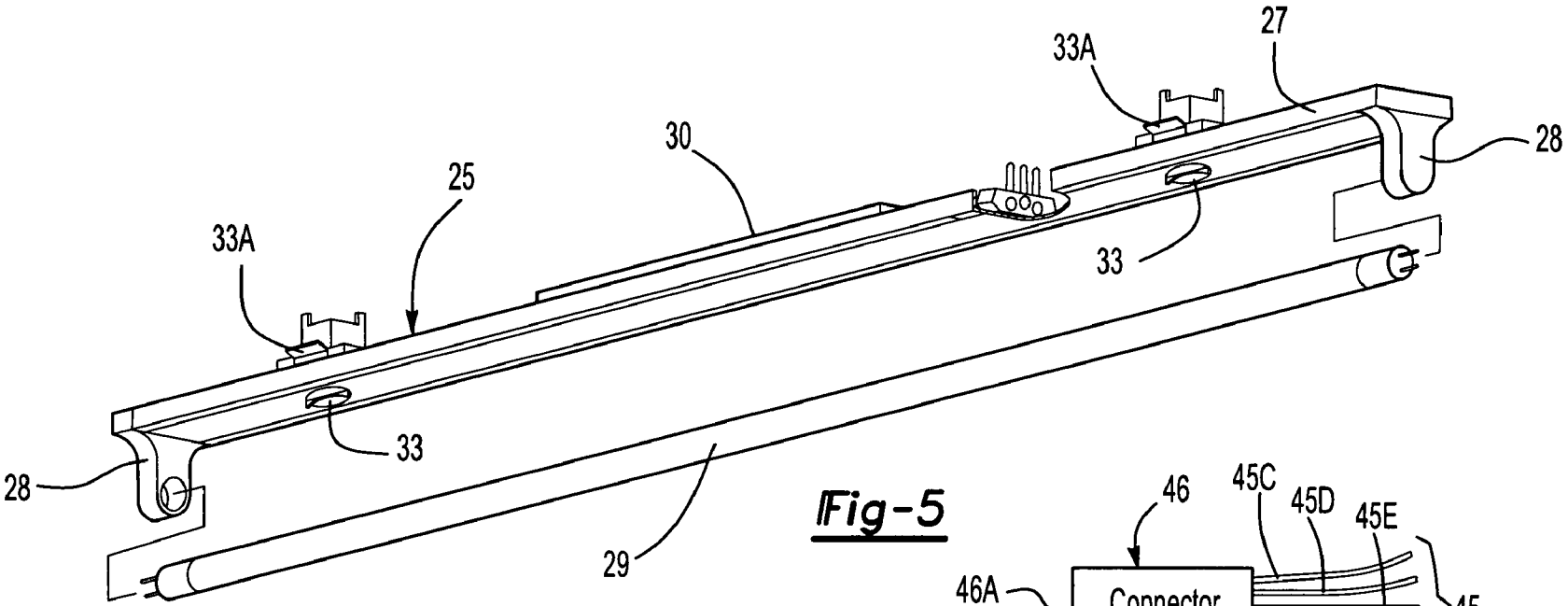
FIG. 5 is a further modification of the construction of the present invention.

Normally, the wiring harness 24 in the known pre-wired bus system 20 will be a standard 3-wire system having live, neutral and ground conductors (24A–C), and may be referred to as a 3-wire single circuit system. As will be shown hereinafter, there are versions of the present invention which may simply plug into such a system. These are shown in FIGS. 3 and 5, which will be discussed below.

However, the great versatility of the present invention can be seen by first referring to a system which can utilize a 5-wire female fixture plug 23A. When five wires are available, they can be used to supply a 5-wire, 3 circuit system, or a single circuit and emergency lighting circuit.

A 5-wire, 3 circuit system can supply 3 different voltages. It would have the neutral and ground conductors of the single circuit system, but would have three different live conductors, each of which could be at a different potential with respect to the neutral conductor. The ground conductor would be a common ground for all three conductors.

The 5-wire single circuit and emergency lighting system comes into play when emergency lighting (not shown) is to be supplied by the multi-function lighting module 25 shown in FIG. 2. Since current electrical codes do not permits sharing of conductors for emergency lighting, two of the five conductors would be used just for the emergency lighting, while the other three would be the live, neutral and ground conductors described above for the standard 3-wire system. When the 5-wire single circuit and emergency lighting system is use, the standard wiring harness 24 found in the prior art trunking 21 is not used.

In the preferred embodiment, to attach multi-function lighting module 25 to bus system 20, one or more twist-locking or CLIX type connectors 33, are attached to body portion 26 of lighting module 25 at predetermined, desired, positions. Each of said twist-locking type connectors 33 has a pair of flanged portions 33A which rotate, and which will engage flanges or grooves 33B on trunking 21 (FIG. 1) to hold the multi-function lighting module 25 to the trunking 21.

To assemble multi-functional lighting module 25 to bus system 20, the body portion 26 of lighting module 25 will be axially aligned with trunking 21, whereby flanges 27 will be in substantial alignment with sides 27A of trunking 21. Hand connection, or continued movement of body portion 26 toward trunking 21 will cause the one or more male fixture plugs 31 to mate with the one or more female fixture receptacles 23 to provide electrical communication there between, and twisting of twist-locking connectors 33 will firmly mount multi-functional lighting module 25 to bus system 20.

Since wiring for emergency lighting is normally not installed in trunking 21, when a module 25 having emergency lighting (not shown is used, a five-wire emergency harness 34 having wiring as described above, and terminating in the female 5-wire connector 23A is supplied. 5-wire male fixture plug 31 will plug into the female 5-wire connector 23A.

5-wire male fixture plug 31 is wired by means well known in the art to supply current to the ballast 30, which is, in turn, in electrical communication with lamps sockets 28, to supply current to fluorescent lamp 29.

Referring to FIG. 3, there is shown a further modification of the present invention. This modification will use the standard 3-wire circuit configuration described above. Mounted to, or attached to, or formed integrally with, body portion 26 of lighting module 25 may be at least one, and preferably, a pair of track heads 35, having connectors 37, for receiving a secondary, or focused, light source 39, which may be such as spotlight 40. Spotlight 40 may be supported by gimbal 41. Gimbal 41 may have mounted thereon a male portion 37B of a second connector 37, which mates with a female portion 37A, to hold gimbal 41 in place and electrically connect spotlight 41 to track head 35. Track head 35 is electrically connected to 3-wire male connector or fixture plug 31A to receive electrical power when lighting module 25 is mounted to trunking 21 as described hereinabove. If one, or both, secondary light sources 39 are not desired, a cover (not shown) can be provided in place of one, or both, track heads 35. As before, ballast 30 is electrically connected to 3-wire male fixture plug 31, and lamp sockets 28 are connected to ballast 30.

There are thus provided two or more possible light source capabilities on a single lighting module wherein power is supplied through a standard bus system to a tool-less (no tools at all are required) means of connection to provide, for example, a general "ambient" source, and a "focused" light source in a single module.

The preferred embodiment described is designed to connect to a standard 3-wire wiring harness 24 found in a majority of lighting applications today. Thus, the "ambient" light source, represented by the fluorescent lamp 29, and the "focused" light source, represented by the spotlight(s) 40 will be supplied by the same voltage supplied by the live, neutral, and ground conductors typically found in the wiring harness 24.

Figure 4:
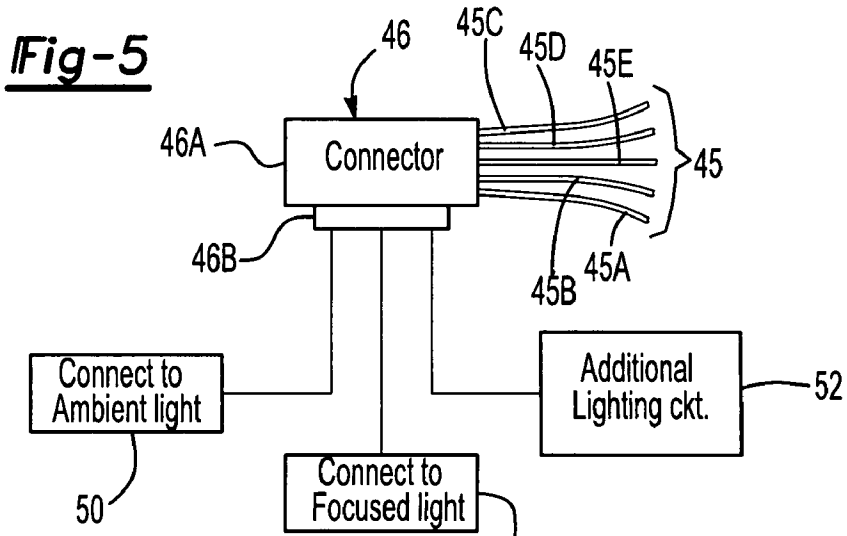
FIG. 4 is a diagrammatic view of a further modification of the present invention.

With reference to FIG. 4, there is shown in diagrammatic form, a modification of the present invention which can be used with the 5 wire-3 circuit wiring harness, such as indicated by the numeral 45, which is becoming known in the art. Such a wiring harness will have first live (45A), neutral (45B), ground (45C) and second live (45D) and third live (45E) conductors. The first live (45A), neutral (45B), ground (45C) and second live (45D) and third live (45E) conductors will be connected to the female portion 46A of a 5-wire power plug 46, which may, but does not need to be, substantially similar to 5-wire female fixture receptacle 31. A male portion 46B of the 5-wire power plug 46 is shown schematically connected to an ambient light source 50, a focused light source 51, and an additional lighting source 52.

By means of the novel construction described above, the needs of retailers and others who need two or more light sources in a single lighting module are supplied by a bus system through a tool less means of connection. A single multi-function lighting module can supply ambient and/or/focused and/or emergency and/or additional lighting.

What is claimed is:

1. A multi-function lighting module comprising:

a) an axially extending body portion;

b) at least one male fixture plug mounted to one side of the axially extending body portion;

c) at least one lamp socket mounted to the other side of the axially extending body portion to receive an ambient light source, and electrically connected to the fixture plug, the at least one lamp socket comprising a pair of sockets mounted in an axially spaced position to the other side of the axially extending body portion; and d) a ballast mounted to the one side of the axially extending body portion and electrically connected to the male fixture plug and each of the pair of sockets.

2. The device defined in claim 1, comprising:

a) a fluorescent tube mounted in the pair of sockets to provide an ambient light source.

3. The device defined in claim 2, and comprising:

a) the at least one male fixture plug comprises a 3-wire male fixture plug.

4. A multi-function lighting module comprising:

a) an axially extending body portion having a pair of parallel spaced apart flanges;

b) a 3-wire male fixture plug mounted to one side of the axially extending body portion;

c) a pair of lamp sockets mounted to the other side of the axially extending body portion;

d) a ballast mounted to the one side of the axially extending body portion and being electrically connected to the 3-wire male fixture plug and the ballast; and e) at least one twist-lock connector mounted to the axially extending body portion to engage a linearly extending trunking and secure the axially extending body portion thereto.

5. The device defined in claim 4, comprising:

a) a 5-wire fixture plug mounted to the one side of the axially extending body portion of the multi-function lighting module; land b) emergency lighting provided on the multi-function lighting module and electrically connected to the 5-wire fixture plug.

6. A multi-function lighting module comprising:

a) an axially extending body portion;

b) a fixture plug mounted to a first side of the axially extending body portion;

c) a ballast mounted to the first side of the axially extending body portion and electrically connected to the fixture plug;

d) a pair of lamp sockets mounted to the other side of the axially extending body portion in an axially spaced position and being electrically connected to the ballast; and e) a pair of track heads mounted to the body portion to receive a focused light source, and electrically connected to the fixture plug.

* * * * *